United States Patent [19]

Uzaki et al.

[11] Patent Number: 4,566,521

[45] Date of Patent: Jan. 28, 1986

[54] MOULDING APPARATUS FOR MAKING GAS HARDENED SAND MOULD

[75] Inventors: Nagato Uzaki, Toyohashi; Toshihisa Komori, Toyokawa; Kazuharu Matui, Toyokawa; Shigehiro Toyoda, Toyokawa, all of Japan

[73] Assignee: Sintokogio Ltd., Nagoya, Japan

[21] Appl. No.: 419,306

[22] Filed: Sep. 17, 1982

[30] Foreign Application Priority Data

Sep. 28, 1981 [JP] Japan ..... 56-154542

[51] Int. Cl.[4] ..... B22C 9/12; B22C 15/22

[52] U.S. Cl. ..... 164/160.1; 164/16; 164/181; 164/323

[58] Field of Search ..... 164/7.1, 16, 160.1, 164/181–184, 194, 323; 198/486, 488

[56] References Cited

U.S. PATENT DOCUMENTS

| | | | |
|---|---|---|---|
| 2,852,818 | 9/1958 | Schallenberger et al. | 164/200 |
| 3,289,256 | 12/1966 | Ferris | 164/181 |
| 4,077,459 | 3/1978 | Buhrer | 164/194 |
| 4,077,461 | 3/1978 | Buhrer | 164/194 |
| 4,129,165 | 12/1978 | Edwards | 164/160.1 |
| 4,183,427 | 1/1980 | Tomikawa | 198/486 |

FOREIGN PATENT DOCUMENTS

| | | | |
|---|---|---|---|
| 2727297 | 12/1977 | Fed. Rep. of Germany | 164/160.1 |
| 2749527 | 5/1978 | Fed. Rep. of Germany | 164/160.1 |
| 2833999 | 2/1980 | Fed. Rep. of Germany | 164/160.1 |
| 46-26221 | 7/1971 | Japan | 164/181 |
| 47-16327 | 9/1972 | Japan | 164/194 |

*Primary Examiner*—Nicholas P. Godici
*Assistant Examiner*—Richard K. Seidel
*Attorney, Agent, or Firm*—Armstrong, Nikaido, Marmelstein & Kubovcik

[57] ABSTRACT

A hopper for providing moulding sand having an opened top and a bottom member having through holes for discharging the sand is positioned spaced apart at a suitable distance horizontally from a cover member connected to a suitable source for generating gas for hardening the moulding sand. A pattern plate provided with vacuum evacuating means is disposed to be selectively connected to either one of the hopper and the cover member for discharging and filling the moulding sands into a flask placed on a pattern plate and for introducing hardening gas and allowing said gas to penetrate and permeate through the layer of sand filled in the flask to harden the filled sand, respectively. By using vacuum evacuation of a hollow chamber in the pattern plate instead of pressurized air and hardening gas under pressure, the entire moulding apparatus can be rendered lighter in construction and smaller in size, while any leakage of poisonous hardening gas can be completely prevented from occurring.

1 Claim, 2 Drawing Figures

MOULDING APPARATUS FOR MAKING GAS HARDENED SAND MOULD

FIELD OF THE INVENTION

This invention relates to an apparatus for making casting moulds, and more particularly, to an apparatus for making gas hardened sand moulds which transfers moulding sand contained in a hopper into a flask and hardens the sand by passing a hardening gas through the sand and flask by virtue of vacuum pressure.

Heretofore, in making a casting mould or moulds by using gas hardenable sand, filling of such sand into a flask has been done by use of compressed air in which pressurized gas or gases are also used as a hardening gas allowing it to penetrate into and pass through the layer of sand and the flask.

Consequently, strict air tightness has been required at the mating surfaces between a flask and a pattern plate thereby necessitating rigid clamping of the above-mentioned members.

This also requires that the apparatus and flask have high structural strength and be of a larger size thus making the moulds quite expensive.

And yet, if the hardening gas to be used is of a poisonous type, great care must be taken to prevent any leakage of such gas from occuring.

The present invention has been contemplated, taking the above-mentioned drawbacks into consideration, to utilize suction force imparted by vacuum for feeding the moulding sand into the flask in which it is to be hardened and for introducing and allowing the hardening gas to pass through the moulding sand.

An object of the present invention is to provide a moulding apparatus for making gas hardened sand moulds which do not require any particular structure for rigidly clamping the flask and the pattern plate together.

A further object of the present invention is to provide a moulding apparatus for making gas hardened sand moulds by using a pattern plate or plates and a flask or flasks, both being of comparatively low strength.

A still further object of the present invention is to provide a moulding apparatus for making gas hardened sand moulds, wherein the hardening gas is sufficiently penetrated into and allowed to entirely contact with the moulding sand and is completely free from any leakage of the hardening gas to the surrounding atmosphere.

Yet a further object of the present invention is to provide a moulding apparatus of the type for moulding gas hardened sand which can be economically manufactured at low cost and is able to avoid any environmental pollution due to leakage of the hardening gas used.

Other objects, distinguishable features and meritorious effects of the present invention will be clearly understood from the following explanations by referring to the accompanying drawings which illustrate the preferred embodiment of the invention.

DETAILED DESCRIPTION OF A PREFERRED EMBODIMENT

Figure 1:
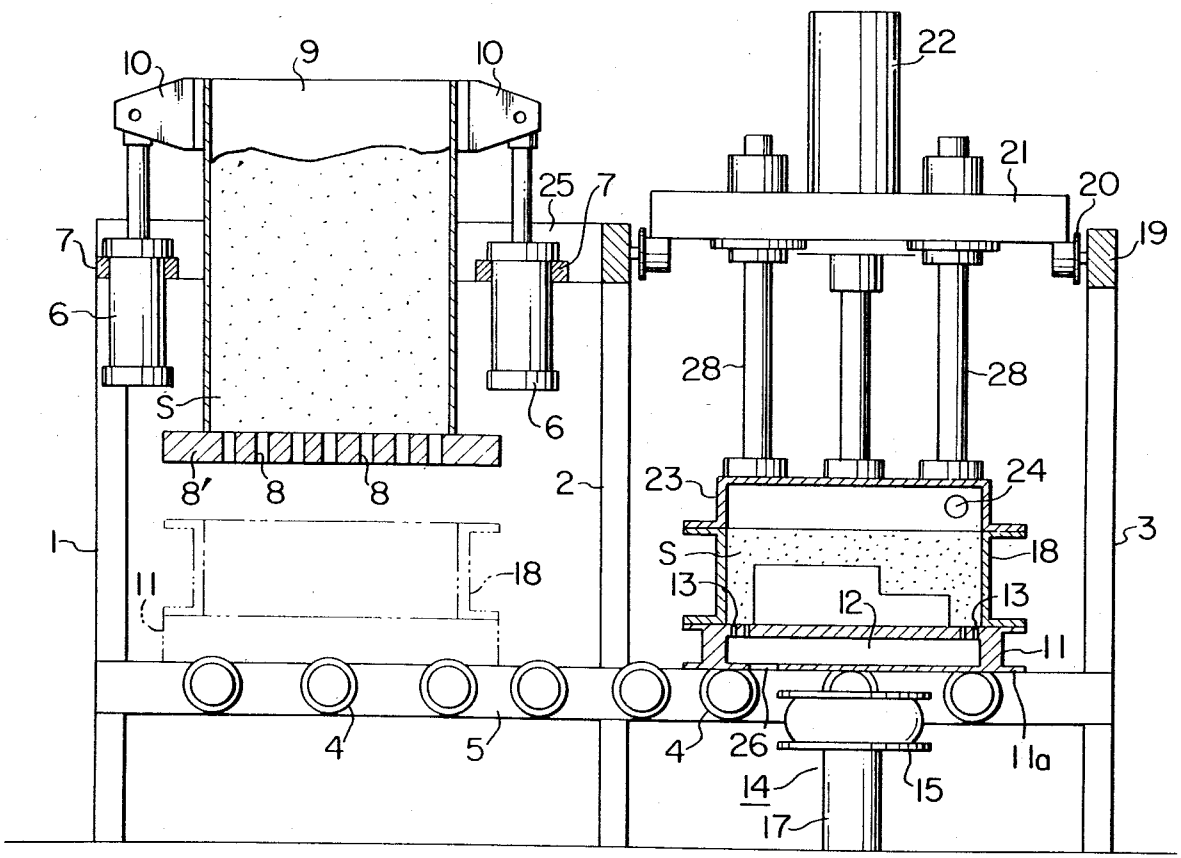
FIG. 1 is a partially cutaway front view.

Numerals 1, 2 and 3 denote three pairs of support columns, each pair of which is disposed upright being aligned together on the foundation from the left side to the right side of the drawing and spaced apart from each other at necessary distances.

A roller conveyor 5 comprising a plurality of flanged rollers 4 is disposed across the spans between the columns 1, 2 and 3 at their lower corresponding positions.

On a pair of frames 25 extending between the two pairs of columns 1 and 2 at their respective upper ends, a pair of vertically directed cylinders 6, 6 are disposed, being spaced apart from each other, each of which is attached to a pair of frames 25 via holding members 7, 7.

Between the opposing upper ends of the two piston rods of the cylinder 6, 6, a hopper 9 is disposed and is connected to the upper end through a pair of linkage members 10, 10.

The hopper 9 is provided with a horizontally extending base plate 8' formed with a number of through holes 8, 8 for discharging moulding sand and having a surface area large enough to close the upper end opening of a flask 18 which will be explained later in more detail.

Numeral 11 denotes a pattern plate having an upper wall, a peripheral side wall, and a bottom wall defining a hollow chamber 12 in its lower portion. The pattern plate 11 has a flange **11*a* extending horizontally outward at its lowermost end and an upper wall with a number of vent holes 13 therein having vent plugs (not shown) through which the hollow chamber 12** communicates with the interior of the flask.

The pattern plate 11 is laid upon the flanged rollers 4, 4 of the roller conveyor 5 so as to be capable of travelling while being rotatably carried on the flanged rollers 4, 4.

The hollow chamber 12 of the pattern plate 11 is connected by a flexible hose such as a rubber hose through a suction hole 36 to a vacuum source for evacuation.

Numeral 14 is a clamping means for tightly fixing the pattern plate 11 on the flanged rollers of the conveyor 5 in the middle position between the two columns 2 and 3.

Figure 2:
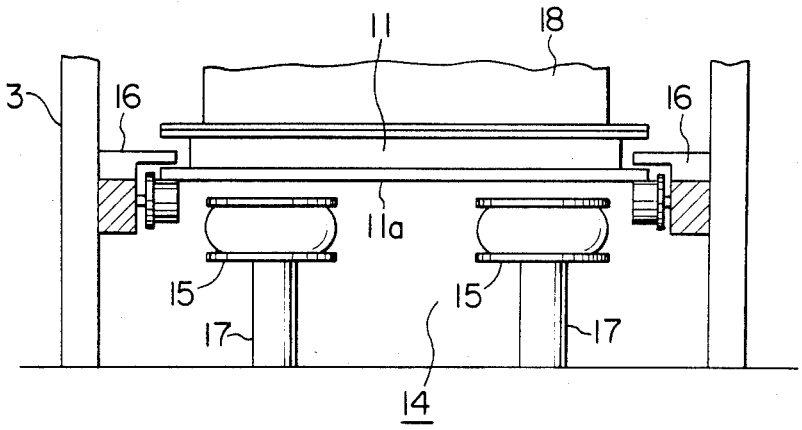
FIG. 2 is a side elevational view showing a clamping device adopted in the present invention, in detail.

The clamping means 14, as shown in FIG. 2, consists of a pair of pneumatic springs 15, 15 for lifting or lowering the pattern plate 11 when actuated by compressed air, a pair of stoppers 16, 16 which clamp the flange **11*a* between each of them and the pneumatic spring 15, 15 which are supported on the foundation through support columns 17** fixed on the foundation.

Numeral 18 is a flask laid upon the pattern plate 11.

Also disposed extending between the opposing upper end of the support columns 2 and 3, is a roller conveyor 19 having flanged rollers 20, 20 and extending normally to FIG. 1.

A travelling trolley 21 is carried on the flanged rollers 20 for allowing free traversing movement, at the central part of which trolley a pneumatic or hydraulic cylinder 22 is disposed passing through the trolley for effecting reciprocal vertical actuation.

At the lower end of the piston rod of the cylinder 22, a cover member 23 for closing the upper opening of the flask 18 is attached preferably being slidably guided by a suitable number of guide columns 28.

The inside space of the cover member 23 is connected via a communication hole 24 to a hardening gas supply source (not shown).

The cover member 23 is also provided with suitable means for clamping and lifting the flask and means for parting the hardened mould.

The moulding apparatus described above functions as follows.

At first the hopper 9 is lowered by the downward stroke of the piston rod of the cylinder 6, 6 so that the bottom plate can close the upper opening of the flask 18 placed on the pattern plate 11.

Upon activation of a vacuum suction device (not shown), the hollow chamber 12 of the pattern plate 11 and the interior of the flask 18 are placed under a vacuum. Thus the gas hardenable sand in the hopper 9 is discharged through the sand discharge holes 8, 8 into the flask 18 and filled therein, due to a pressure difference between the atmospheric pressure acting on the surface of the sand layer and the reduced pressure under the base plate.

After the elapse of a pre-determined period of time, vacuum filling operation is stopped and then the hopper 9 is lifted upward by the upward movement of the piston rod of the cylinder 6, 6.

The flask 18 having been filled with the moulding sand and the pattern plate together are transferred to the position immediately above the clamping device 14 provided at the rightside of the hopper 9, where the cover member 23 is placed upon the upper opening of the flask for covering the flask by the downward movement of the piston rod of the cylinder 22.

Subsequently, interior of the flask 18 is subjected to a vacuum exerted by a vacuum source (not shown) for introducing a hardening gas to the surface of the gas hardenable sand S filled by the preceding step.

The hardening gas thus introduced is further sucked in and allowed to penetrate and permeate through the sand and is discharged outwards through the vent holes 13, 13 and the hollow chamber 12, resulting in hardening of the filled moulding sand in the flask.

This hardening operation is continued for a further pre-determined period of time, and then the vacuum suction means is disconnected from the flask.

Next, compressed air is introduced into the pneumatic spring 15, 15 of the clamping device to lift the pattern plate 11 and the flask 18 filled with hardened sand together, while clamping the pattern plate 11 by the clamping device 14.

After having been coupled with a lifting device (not shown), the flask 18 containing therein the already hardened moulding sand is lifted upward together with the cover 23 by means of a upward movement of the piston rod of the cylinder 22, as the result, the flask 18 is removed away from the pattern plate 11.

After the parting from the pattern plate, the travelling trolley 21 carrying the flask 18 containing the hardened sand is transferred to a position, where the moulded and hardened sand mould is parted from the flask 18 by a stripping device, not shown.

Next, the travelling trolley 21 is retracted to transfer the cover member 23 and the flask 18 now empty, to the position just above the pattern plate 11 and then the empty flask is laid on the pattern plate 11 once more.

Upon disengagement of the clamping and lifting device from the flask 18 and cover member 23, the cover member 23 is lifted upward by the upward movement of the piston rod of the cylinder 22.

Next, the compressed air in the pneumatic springs 15, 15 is released to unclamp the pattern plate 11 carrying the flask 18 for allowing them to be placed on the flanged rollers 4, 4 and further to revert back to the position immediately below the hopper 9 and thus the one cycle of operation is completed.

According to the embodiment explained above, the parting of the moulded sand is performed as a parting step; however, this step can be dispensed with and alternatively, moulding operation can be done by laying other empty flasks one after another onto the pattern plate 11 when the gas hardening of the moulding sand in the preceding step has been completed.

Clamping of the pattern plate at the step of its removal from the flask is not necessarily limited to a pneumatic spring type but any other suitable means can be used, for example, a conventional hydraulic or pneumatic cylinder can be used.

Although the hopper 9 in the above-mentioned embodiment is illustrated as being movable upward and downward, alternatively, lifting means for upward movement of the pattern plate and the flask can be arranged below the hopper.

Since the moulding apparatus of the present invention is constructed and functions as mentioned above, the filling of the moulding sand into a flask can be done by a mere application of vacuum to the pattern plate placed beneath the flask.

Accordingly, the moulding apparatus as a whole can be made light in construction and smaller in size as compared with a conventional one having a blowing head which blows in moulding sand with compressed air.

Moreover, hardening gas is penetrated and permeated through the moulding sand filled in the flask under vacuum suction, therefore no fear of gas leakage as is probable in the conventional blowing-in type is necessary, and at the same time, the present moulding device wherein hardening gas is introduced under vacuum suction into the flask, can be made light in construction and smaller in size as compared with a conventional one which hardening gas flows into the flask by utilizing positive pressure.

What is claimed is:

1. A moulding apparatus for making gas hardened sand moulds comprising:

a pattern plate having an upper wall on which a pattern is placeable and having a plurality of vent holes therein, a bottom wall, a peripheral side wall and at least one flange, said upper wall, side wall and bottom wall defining a hollow chamber having means connectible to a source of vacuum, a hollow flask having an open upper end, an open lower end, and a peripheral side wall, said flask being releasably laid on the upper wall of said pattern plate and, when laid thereon, forming an enclosure with a closed side wall periphery around a pattern placed on said pattern plate with the upper end of said enclosure open, conveyor means for reciprocally and horizontally moving said pattern plate with said flask so laid thereon between a first position for filling moulding sand into said flask surrounding a pattern on said pattern plate and a second position for hardening the filled moulding sand, means for clamping said pattern plate in said second position for preventing upward movement of said pattern plate, said means for clamping comprising a stopper disposed above said pattern plate flange and at least a pneumatic spring for urging said pattern plate upward such that the upper face of said pattern plate flange forcibly engages said stopper, hopper means for providing moulding sand disposed above said flask at said first position and having a top open to the atmosphere and a bottom plate with a surface large enough to close said upper open end of said flask, said bottom plate having a plurality of through holes for discharging moulding sand contained in said hopper means into said hollow flask through said flask end and fill said flask without pressure above atmospheric pressure being applied to said hopper means and said sand therein, means for reciprocally and vertically moving said hopper means relative to said flask, a rigid cover member disposed above said flask at said second position and being releasably and sealably layable upon said open upper end of said flask, said cover member having an open bottom, a closed top and defining with said flask when sealably laid thereon a chamber for receiving hardening gas, and means on said cover member connectible to a source of hardening gas, and means for reciprocally and vertically moving said cover member relative to said flask for sealably laying said open bottom of said cover member over said upper open end of said flask;

whereby, when said pattern plate with said flask so laid thereon are in said first position, moulding sand can be filled from said hopper means and drawn into said flask solely by vacuum by lowering the hopper means onto the flask and applying a vacuum to said hollow chamber to pull the sand down into and fill the flask and compact the sand without application of additional pressure to the sand and, when said pattern plate with said flask so laid thereon and with said sand therein are in said second position, the hardening gas can penetrate the moulding sand solely by vacuum by lowering the cover member to seal said open upper end of said flask and applying a vacuum to said hollow chamber to draw hardening gas down through the sand.

* * * * *